US005181398A

United States Patent [19]

Tanaka et al.

[11] Patent Number: 5,181,398

[45] Date of Patent: Jan. 26, 1993

[54] DEHYDRATOR

[75] Inventors: Tetsukazu Tanaka, Nagoya; Masahiro Imai; Hiroshi Ikeda, both of Seto; Yosiyuki Makino, Nagoya, all of Japan

[73] Assignee: Kabushiki Kaisha Toshiba, Kanagawa, Japan

[21] Appl. No.: 746,244

[22] Filed: Aug. 15, 1991

[30] Foreign Application Priority Data

Aug. 28, 1990 [JP] Japan ..... 2-226918

[51] Int. Cl.[5] ..... D06F 33/02

[52] U.S. Cl. ..... 68/12.06; 68/12.14

[58] Field of Search ..... 68/12.06, 12.14

[56] References Cited

U.S. PATENT DOCUMENTS 2,975,902 3/1961 Pinder ..... 68/12.06

3,152,462 10/1964 Elliott et al. ..... 68/12.06 X 4,411,664 10/1983 Rickard et al. ..... 68/12.06 X 4,513,464 4/1985 Rettich et al. ..... 68/12.14 X 4,782,544 11/1988 Nystuen et al. ..... 68/12.14 X

FOREIGN PATENT DOCUMENTS 0369270 5/1990 European Pat. Off. ..... 68/12.14

*Primary Examiner*—Philip R. Coe

*Attorney, Agent, or Firm*—Limbach & Limbach

[57] ABSTRACT

A dehydrator includes a dehydration basket for containing clothes to be dehydrated, a variable speed motor such as a dc brushless motor for driving the dehydration basket so that the basket is rotated for dehydrating the clothes, and a microcomputer-based control device controlling rotational speed of the motor so that the rotational speed of the motor is increased stepwise when a dehydration operation is initiated.

3 Claims, 6 Drawing Sheets

DEHYDRATOR

BACKGROUND OF THE INVENTION

This invention relates to a dehydrator wherein a dehydration basket is driven by a variable speed motor so that the basket is rotated to dehydrate clothes contained in it.

The inventors have proposed a dehydrator such as a fully automatic clothes washing machine which is so arranged that an agitator and a wash and dehydration rotational tub serving as a dehydration basket containing clothes are driven by a variable speed motor. A dc brushless motor is employed as the variable speed motor in this arrangement. In a dehydration operation, the dc brushless motor is rotated at a predetermined rotational speed so that the rotational tub and the agitator are rotated at the predetermined rotational speed In this case the rotational speed of the dc brushless motor is controlled so as to be linearly increased until the predetermined rotational speed is reached after initiation of the dehydration operation.

In the above-described arrangement, control data for controlling the motor rotational speed is increased in a microcomputer-based control circuit controlling the motor rotational speed. The control data is representative of voltages applied to the -dc brushless motor.

However, noise is produced when the rotational speed of the dc brushless motor is increased by increasing the abovementioned control data, which noise gives a user an unpleasant feeling Further, the noise produced at the time of initiation of the dehydration operation is loud.

The inventors then tried to find the cause of the noise produced at the time the motor is accelerated. In the case where the motor is accelerated, the motor clanks every time the control data is increased. When the control data representative of a target rotational speed is supplied to the motor or when the voltage corresponding to the control data is applied to the motor, some period of time is required for the actual motor speed to reach the target rotational speed. Accordingly, the motor rotational speed is continuously increased every time the control data is increased. It is considered that clanking results from the continuous increase in the motor rotational speed. Since the motor rotational speed is continuously increased until a predetermined speed is reached after initiation of the dehydration operation, the motor clanks continuously, which causes a rumbling sound giving the user the unpleasant feeling.

SUMMARY OF THE INVENTION

Therefore, an object of the present invention is to provide a dehydrator wherein the sound offensive to the ear can be prevented from being produced and the noise produced at the time of initiation of the dehydration operation can be reduced.

It has been found by the inventors that when the control data is continuously increased to accelerate the motor at the time of initiation of the dehydration operation, the motor rotational speed is continuously increased, resulting in the noise offensive to the ear. Accordingly, the noise can be reduced by avoiding the continuous increase in the motor rotational speed at the time of acceleration The present invention relies upon this notion.

The present invention provides a dehydrator comprising a dehydration basket for containing clothes to be dehydrated, a variable speed motor comprising a dc brushless motor for driving the dehydration basket so that the basket is rotated for dehydrating the clothes, the dc brushless motor being controlled so that a rotational speed thereof is varied by varying a voltage applied thereto, and motor speed control means for controlling the rotational speed of the dc brushless motor so that the rotational speed of the motor is increased toward a final target speed by increasing a value of control data corresponding to the voltage applied to the dc brushless motor when a dehydration operation is initiated, the value of the control data being increased for a plurality of periods, and during each period the value of the control data is held without being increased for a set period of time, so that the value of the control data is increased stepwise.

In accordance with the dehydrator of the invention, the rotational speed of the motor is increased stepwise at the time of initiation of the dehydration operation. Accordingly, the actual motor speed is maintained at each intermediate target speed when each intermediate target speed is reached, thus avoiding the continuous increase in the motor speed. Consequently, the sound produced at the time of acceleration is not continuous and is reduced in its level. The sound produced at the time of initiation of the dehydration operation can be prevented from becoming offensive to the ear, not giving the user an unpleasant feeling. Further, the noise produced at the time of initiation of the dehydration operation can be reduced as a whole.

The dehydrator of the invention may further comprise rotational speed detecting means for detecting the rotational speed of the motor and abnormal condition detecting means for detecting an abnormal condition of the motor with respect to the rotational speed based on the detected rotational speed output by the rotational speed detecting means. Since the abnormal condition of the motor with respect to its rotational speed can be detected by the abnormal condition detecting means, the motor may be deenergized after detection of the abnormal condition and the user may be warned against the motor abnormal condition, for example.

Preferably, the abnormal condition detecting means may be arranged to detect the abnormal condition of the motor with respect to the rotational speed when the detected rotational speed is below a first-stage target rotational speed or when the detected rotational speed is at an abnormal condition determination rotational speed or above higher than a last-stage target rotational speed.

Other objects of the present invention will become obvious upon understanding of the illustrative embodiments about to be described or will be indicated in the appended claims. Various advantages not referred to herein will occur to one skilled in the art upon employment of the invention in practice.

DESCRIPTION OF THE PREFERRED EMBODIMENTS

A first embodiment of the present invention will be described with reference to FIGS. 1 to 5 of the accompanying drawings.

Figure 2:
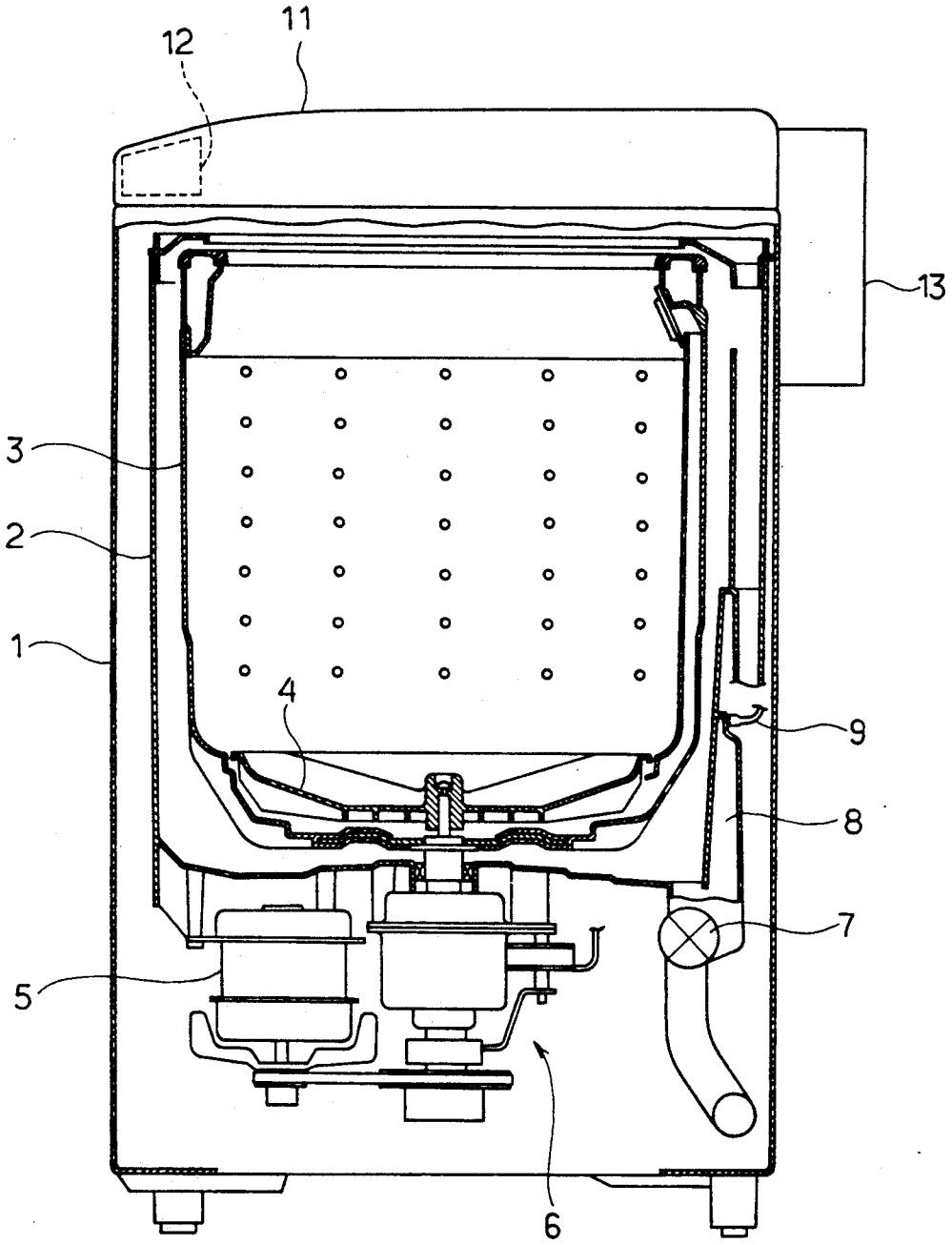
FIG. 2 is a longitudinal section of the washing machine.

Referring first to FIG. 2, a fully automatic clothes washing machine embodying the invention comprises an outer casing 1 and a water-receiving tub 2 mounted in the outer casing 1. A dehydration basket or, for example a rotational tub 3 for dehydrating and washing operations is rotatably mounted in the water-receiving tub 2. An agitator 4 having a large diameter is rotatably mounted on the inner bottom of the rotational tub 3. A variable speed motor 5 such as a three phase dc brushless motor is mounted on the outer bottom of the water-receiving tub 2. A mechanism section 6 including a reduction gear mechanism is also provided on the outer bottom of the water-receiving tub 2. The mechanism section 6 transmits reduced rotation of the motor 5 to the agitator 4 in each of wash and rinse operations, so that the agitator 4 is rotated. In a dehydration operation the mechanism section 6 transmits the rotation of the motor 5 to both the rotational tub 3 and the agitator 4 so that they are simultaneously rotated at a high speed. A drain valve 7 is provided in a drainage path from the water-receiving tub 2. An air trap 8 is formed near the bottom of the water-receiving tub 2. A water level sensor 10 (see FIG. 3) is connected to the air trap 8 through an air tube 9. A top cover 11 is mounted on the top of the outer casing 1. A control device 12 is provided in the front portion of the top cover 11 for controlling the wash, rinse and dehydration operations. A motor speed control device 13 is provided on the upper rear of the outer casing 1 for driving the motor 5 and controlling its speed.

Figure 3:
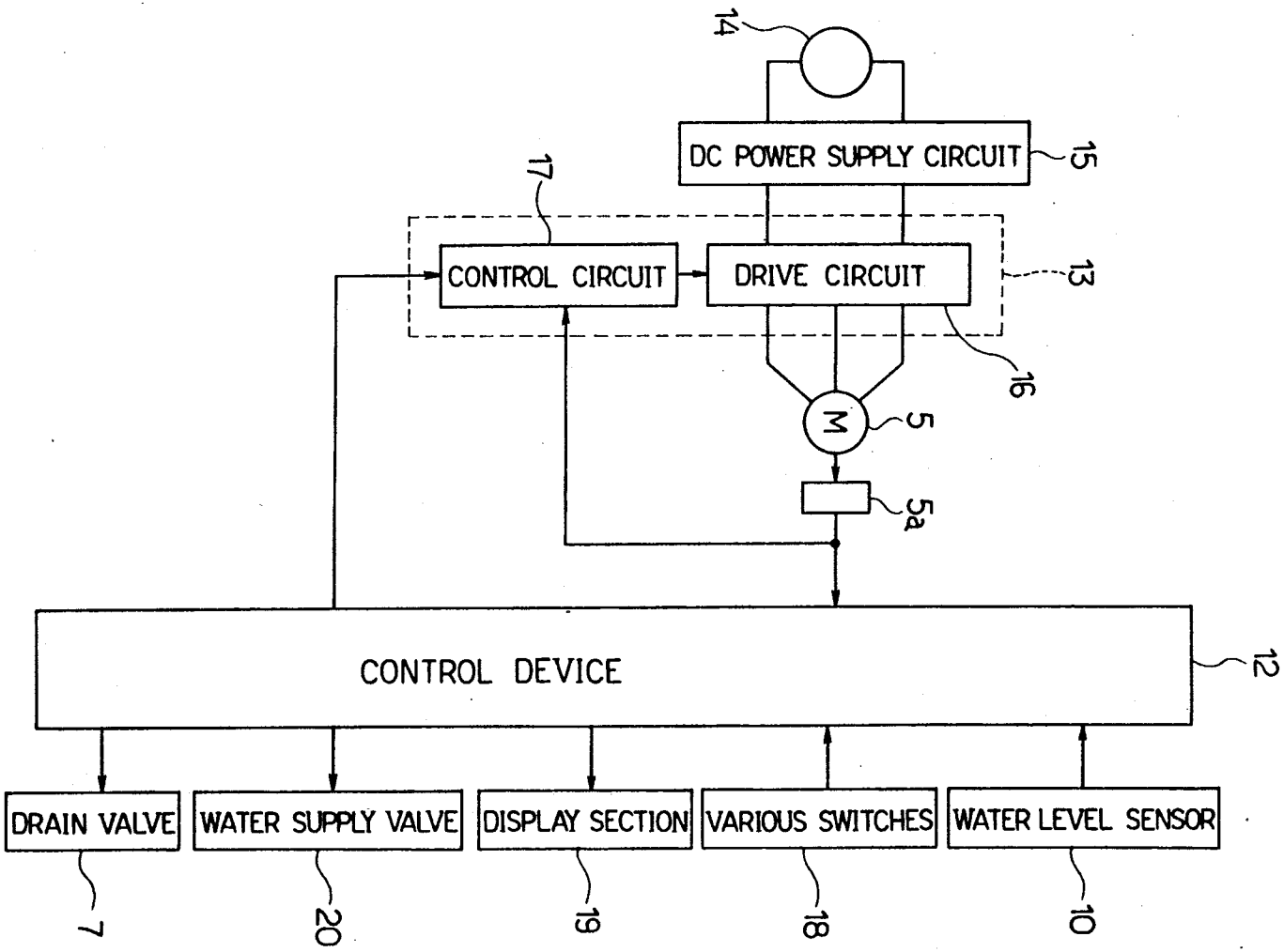
FIG. 3 is a block diagram showing an electrical arrangement of the washing machine.

An electric power feed circuit for the motor 5 will now be described with reference to FIG. 3. A dc power supply circuit 15 comprising a diode bridge and a smoothing capacitor is connected to an ac power source 14. A dc output from the dc power supply circuit 15 is supplied to a drive circuit 16 forming a part of the motor speed control device 13. A drive coil of the motor 5 is energized at a suitable timing by a control circuit 17 forming a part of the motor speed control device 13 based on a position detection signal generated by a position sensor 5*a* comprising a Hall element, for example and enclosed in the motor 5 for detecting the rotational position of a rotor of the motor 5. In response to a speed control signal from the control device 12, the control circuit 17 adjusts the voltage applied to the motor 5 by way of a pulse width modulation (PWM) control, thereby controlling the rotational speed of the motor 5. The control device 12 comprises, for example, a microcomputer incorporating an internal memory for storing a program for controlling the wash, rinse and dehydration operations. The control device 12 is provided with a function of motor speed control means. More specifically, the control device 12 detects the rotational speed of the motor 5 in receipt of the position detection signal from the position sensor 5*a* and further, delivers a motor speed control signal to the control circuit 17 so that the motor 5 is driven at a necessary rotational speed. Additionally, the control device 12 receives input signals from various switches 18 mounted in an operation panel (not shown) and a water level signal from the water level sensor 10. The control device 12 then activates a display section provided in the operation panel, the drain valve 7 and a water supply valve 20.

Figure 4:
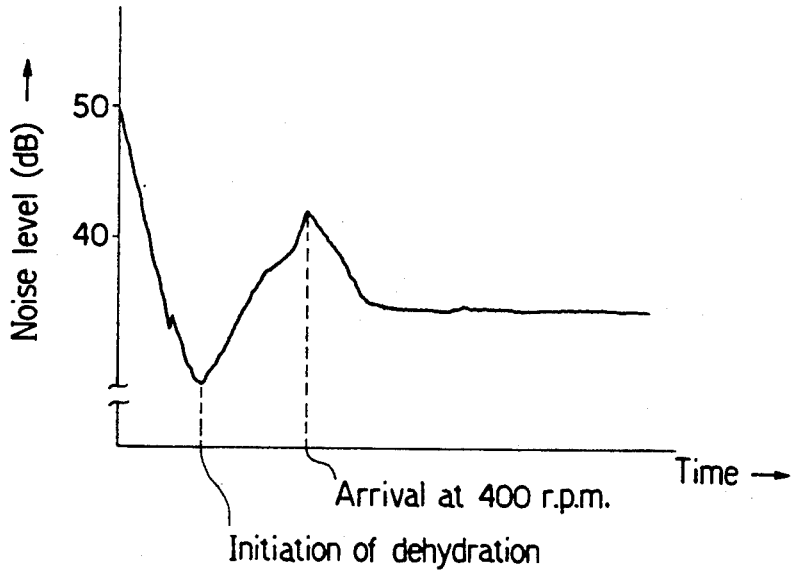
FIGS. 4 and 5 are graphs showing noise measured.
Figure 5:
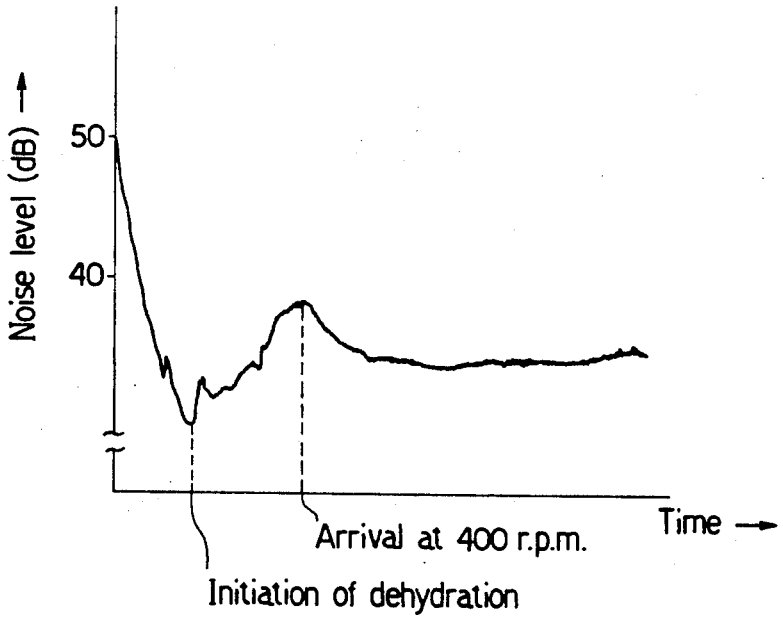

The operation of the washing machine will be described with reference to FIGS. 1, 4 and 5 in addition to FIGS. 2 and 3. In executing the dehydration operation, the rotational speed of the rotational tub 3 or the motor 5 is set to 400 r.p.m., for example. The motor speed is increased stepwise as shown by a solid line P in FIG. 1 when the motor 5 in the stopped state is accelerated until its speed reaches 400 r.p.m. More specifically, when the speed of 400 r.p.m. is represented by the control data, 50*h*, in the control device 12, the motor 5 is controlled to be rotated stepwise at the speeds represented by the respective control data, 10*h*, 20*h*, 30*h* and 40*h*. Each control data corresponds to the voltage applied to the motor 5 and "h" in "10*h*" indicates that "10" is a hexadecimal number, for example. The motor 5 is held at each rotational speed represented by each of the control data 10*h*–40*h* for a predetermined period t2 so that the motor 5 is accelerated stepwise. The motor 5 is accelerated stepwise in acceleration periods between the control data 10*h* and 20*h*, 20*h* and 30*h*, 30*h*and 40*h*, and 40*h* and 50*h*. The control data is linearly increased in these periods so that the motor 5 is accelerated. In this case the linear increase means that the motor speed is increased in such a large number of steps that the increase in the motor speed is approximately linear. Each acceleration period is set to a predetermined period, t3, in the embodiment, which period is set so that the relation, t2 t3, is held.

Figure 1:
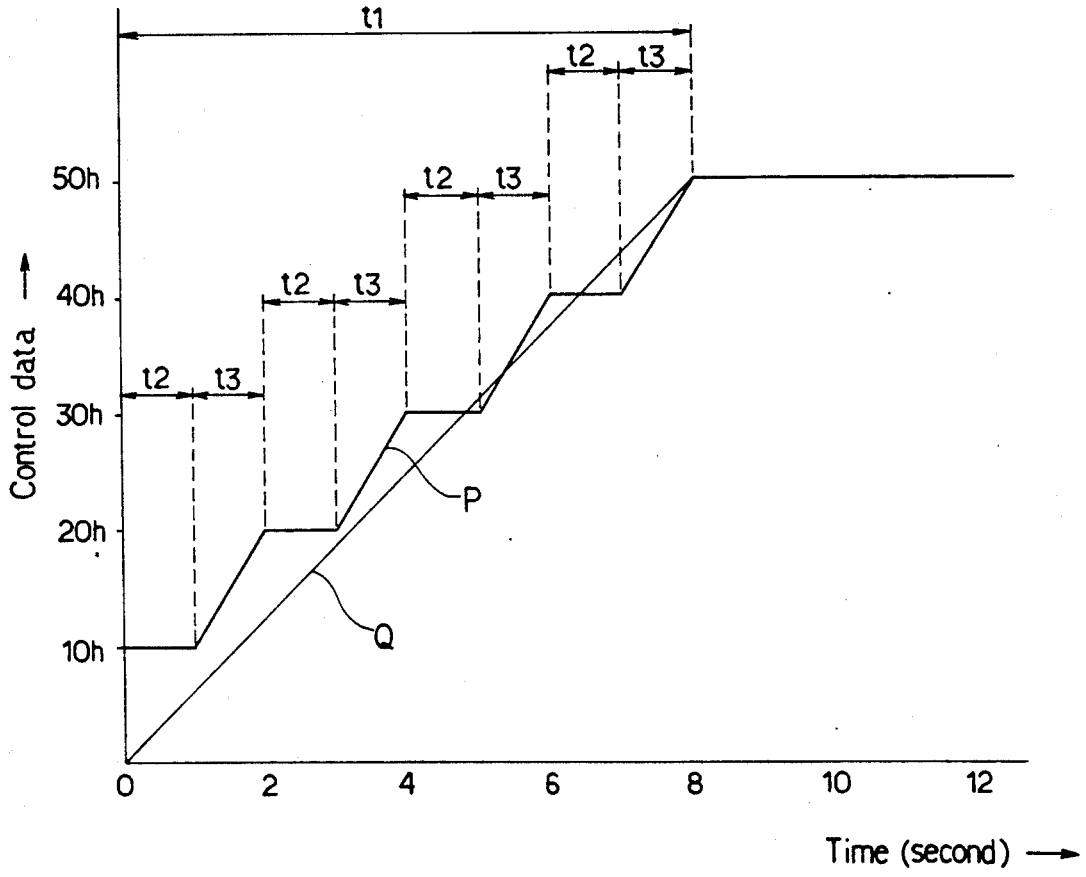
FIG. 1 is a graph showing changes in the rotational speed of a motor employed in the washing machine of a first embodiment in accordance with the present invention.

A solid line Q in FIG. 1 represents the acceleration of the motor in the conventional arrangement. The control data is linearly increased in the period t1 when the motor in the stopped state is accelerated until its speed reaches 400 r.p.m. FIG. 4 shows the noise produced at the time of initiation of the dehydration operation from the motor accelerated as shown by the solid line Q in FIG. 1 in the conventional arrangement. FIG. 5 shows the noise produced at the time of initiation of the dehydration operation from the motor 5 in the embodiment.

In accordance with the above-described arrangement, the rotational speed of the motor 5 is increased stepwise (through five steps) at the time of initiation of the dehydration operation. More specifically, since the control data is increased stepwise at equal intervals, the actual motor speed is held at each intermediate target speed when each intermediate target speed is reached, thus avoiding the continuous increase in the motor speed. Consequently, the sound produced at the time of acceleration is not continuous and is reduced in its level. The sound produced at the time of initiation of the dehydration operation can be prevented from becoming offensive to the ear, not giving the user an unpleasant feeling. Further, as obvious from the results of noise measurement shown in FIGS. 4 and 5, the noise produced at the time of initiation of the dehydration operation can be reduced as compared with the conventional arrangement.

Although the rotational speed of the motor 5 is increased through the five steps at the time of initiation of the dehydration operation in the foregoing embodiment, the motor speed may be increased through one to four steps or six or more steps.

Figure 6:
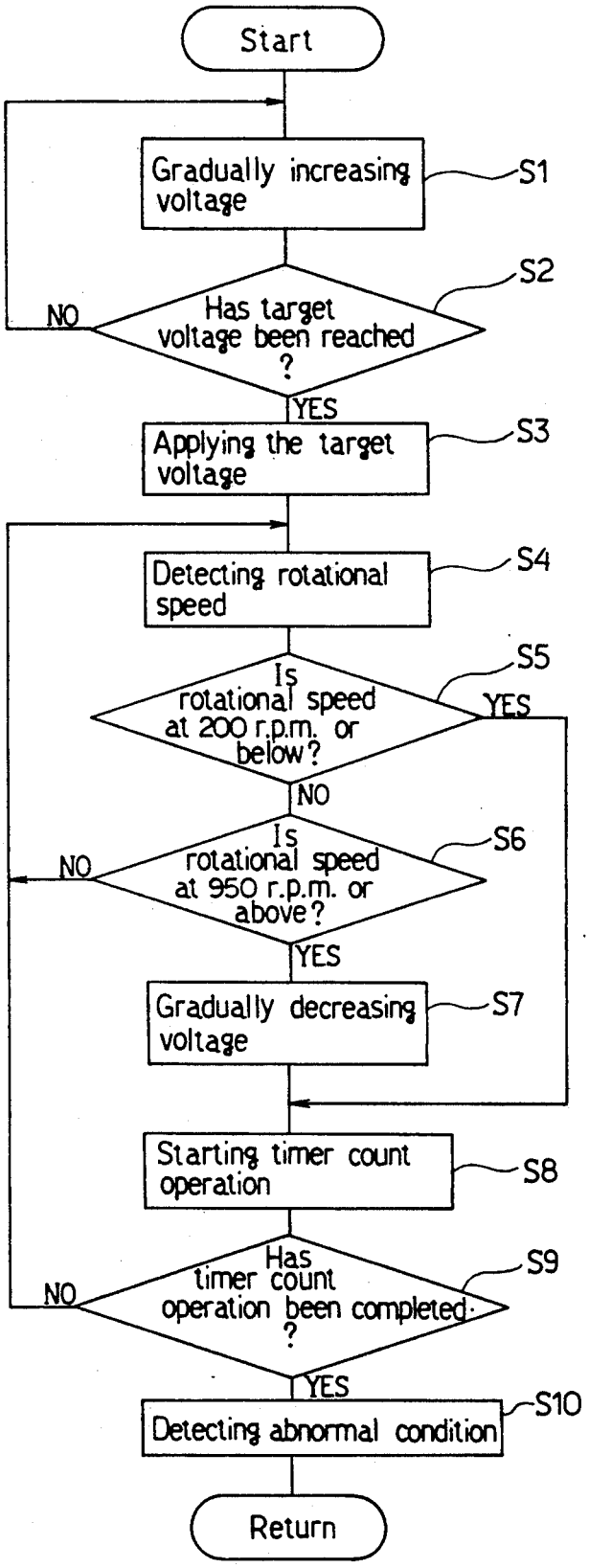
FIG. 6 is a flowchart explaining the motor speed control in the washing machine of a second embodiment.
Figure 7:
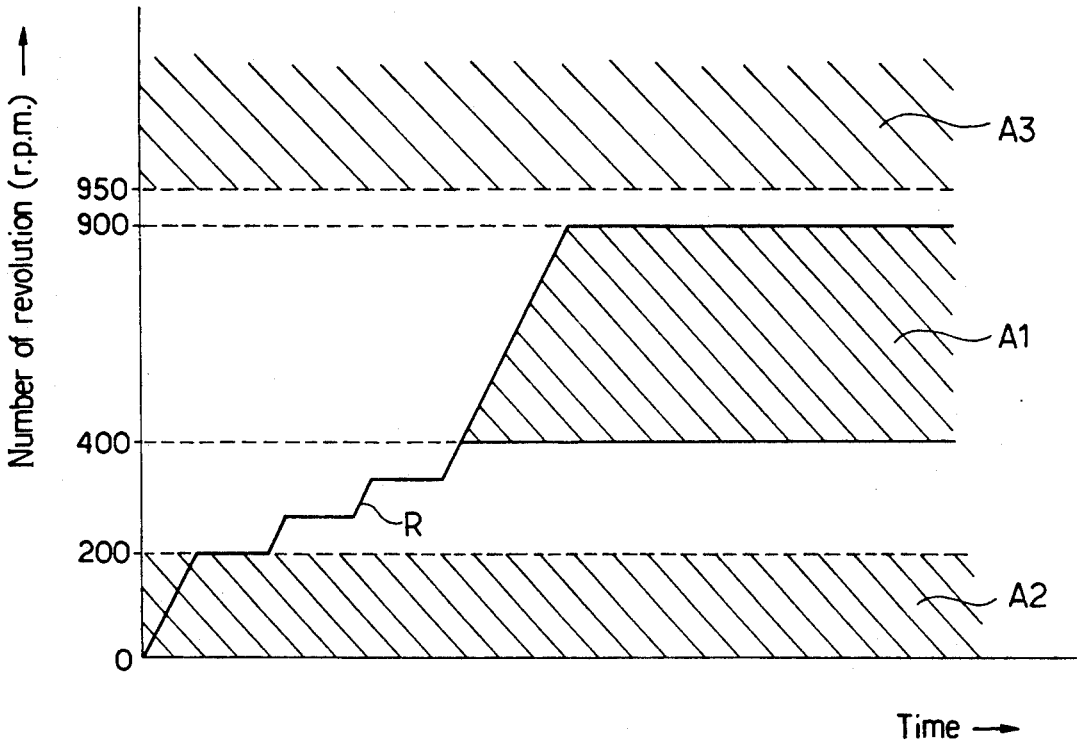
FIG. 7 is a graph showing changes in the motor rotational speed.

FIGS. 6 and 7 show a second embodiment of the invention. Referring to FIG. 6, the voltage applied to the motor 5 is gradually increased so that each target voltage is applied (steps S1, S2 and S3). Consequently, the rotational speed of the motor 5 and namely, the rotational tub is increased stepwise as shown by a solid line R and the dehydration operation is performed in the speed range between 400 r.p.m. and 900 r.p.m. (an oblique line domain A1).

When the actual motor speed is not increased in excess of the first-step target speed, for example 200 r.p.m. for some failure or when the actual motor speed is maintained in an oblique line domain A2, the motor speed is detected at step S4. Since the detected speed is 200 r.p.m. or below, an abnormal condition of the motor 5 with respect to its rotational speed is detected at step S10 after this abnormal low speed condition continues for a predetermined period of time (steps S8 and S9). The abnormal low speed condition is defined as 200 r.p.m. or below because the motor resonates to the water-receiving tub at the natural frequency of the tub, resulting in increase in the unbalance and noise.

On the other hand, when the actual motor speed is increased over an abnormal condition determination speed (for example, 950 r.p.m.) higher than the final target speed or when the actual motor speed is in an oblique line domain A3, the motor speed is detected at step S4. Since the motor speed is 950 r.p.m. or above, the voltage applied to the motor is gradually decreased at step S7. Consequently, when the motor speed is decreased below 950 r.p.m., the dehydration operation is continued. In the case where the abnormal high speed condition is continued for a predetermined period of time even when the voltage applied to the motor is decreased (steps S8, S9), the abnormal condition is detected at step S10.

When the abnormal condition is detected, the dehydration operation is interrupted. The dehydration operation is then restarted after a well-known unbalance modifying operation is performed. In case the abnormal condition is detected even after the unbalance modifying operation is performed several times, a buzzer or display device is activated so that the user is warned against the abnormal condition.

In accordance with the second embodiment, the abnormal rotation such as the abnormally low or high speed can be detected. Consequently, the unbalance and noise can be prevented from being increased, which can improve security.

Although it is determined at step S5 whether or not the detected motor speed is 200 r.p.m. or below, it is determined whether or not the detected motor speed is below 200 r.p.m., instead.

The foregoing disclosure and drawings are merely illustrative of the principles of the present invention and are not to be interpreted in a limiting sense. The only limitation is to be determined from the scope of the appended claims.

We claim:

1. A dehydrator comprising:

a) a dehydration basket for containing clothes to be dehydrated;

b) a variable speed motor comprising a dc brushless motor for driving the dehydration basket so that the basket is rotated for dehydrating the clothes, the dc brushless motor being controlled so that a rotational speed thereof is varied by varying a voltage applied thereto; and c) motor speed control means for controlling the rotational speed of the dc brushless motor so that the rotational speed of the motor is increased toward a final target rotational speed by increasing a value of control data corresponding to the voltage applied to the dc brushless motor when a dehydration operation is initiated, the value of the control data being increased for a plurality of periods, and during each period the value of the control data is held without being increased for a set period of time, so that the value of the control data is increased stepwise.

2. A dehydrator according to claim 1, which further comprises rotational speed detecting means for detecting the rotational speed of the motor and abnormal condition detecting means for detecting an abnormal condition of the motor with respect to the rotational speed based on the detected rotational speed output by the rotational speed detecting means.

3. A dehydrator according to claim 2, wherein the abnormal condition detecting means is arranged to detect the abnormal condition of the motor with respect to the rotational speed when the detected rotational speed is below a first-stage target rotational speed or when the detected rotational speed is at an abnormal condition determination rotational speed or above said final target rotational speed.

* * * * *